US005353610A

United States Patent [19]

Barea

[11] Patent Number: 5,353,610

[45] Date of Patent: Oct. 11, 1994

[54] DEVICE FOR CONTROLLING THE FEED OF AT LEAST ONE YARN TO A TEXTILE MACHINE SO AS TO COMPENSATE ANY PULLING AND EXCESS TENSION EXERTED ON THE YARN

[75] Inventor: Tiziano Barea, Busto Arsizio, Italy

[73] Assignee: International Trading S.r.l., Italy

[21] Appl. No.: 95,694

[22] Filed: Jul. 21, 1993

[30] Foreign Application Priority Data

Jul. 28, 1992 [IT] Italy ..... MI92 A 001836

[51] Int. Cl.[5] ..... D04B 35/12

[52] U.S. Cl. ..... 66/161; 200/61.14

[58] Field of Search ..... 66/157, 160, 161, 162, 66/163; 242/36 R; 57/81; 28/186, 187, 188, 189; 200/61.13, 61.14, 61.18

[56] References Cited

U.S. PATENT DOCUMENTS

| | | | |
|---|---|---|---|
| 3,571,680 | 2/1971 | Tellerman et al. | 200/61.14 X |
| 3,650,128 | 3/1972 | Ferda et al. | 66/161 X |
| 3,888,095 | 6/1975 | Philip | 66/163 |
| 3,890,810 | 6/1975 | Domig | 66/161 |
| 4,002,044 | 1/1977 | Dollat | 66/161 |
| 4,075,445 | 2/1978 | Kempf | 66/163 X |
| 4,859,860 | 8/1989 | Poterala | 200/61.13 X |

FOREIGN PATENT DOCUMENTS

| | | |
|---|---|---|
| 1800125 | 1/1970 | Fed. Rep. of Germany . |
| 2459954 | 6/1975 | Fed. Rep. of Germany . |
| 2523277 | 1/1977 | Fed. Rep. of Germany . |
| 2657134 | 6/1978 | Fed. Rep. of Germany . |
| 3824034 | 9/1989 | Fed. Rep. of Germany . |
| 2395933 | 1/1979 | France . |
| 2231341 | 11/1990 | United Kingdom . |

*Primary Examiner*—Clifford D. Crowder
*Assistant Examiner*—John J. Calvert
*Attorney, Agent, or Firm*—Steinberg, Raskin & Davidson

[57] ABSTRACT

A device for controlling the feed of at least one yarn (14) to a textile machine (15) and for compensating any pulling and excess tension exerted on said yarn (14) during said feed, the yarn (14) being unwound from a usual bobbin (16), comprises support means (13) arranged to slidingly cooperate with the yarn (14) and to support it during its feed to the textile machine (15), said support means (13) being movably associated with winding and unwinding means (3) fixedly supported on the machine (15) by a support member (21), said winding and unwinding means (3) comprising means (6) which compensate the movement of the support means (13) and which slidingly cooperate with the yarn (14), means (25, 28) being provided for sensing the movement of said support means (13), said sensor means (25, 28) being connected to means (30) which control the operation of the textile machine (15) and which are arranged to halt this latter when a predetermined movement limit for said support means (13) is reached.

21 Claims, 2 Drawing Sheets

DEVICE FOR CONTROLLING THE FEED OF AT LEAST ONE YARN TO A TEXTILE MACHINE SO AS TO COMPENSATE ANY PULLING AND EXCESS TENSION EXERTED ON THE YARN

BACKGROUND OF THE INVENTION

This invention relates to a device for controlling the feed of at least one yarn to a textile machine and for compensating any pulling and excess tension exerted on said yarn during said feed, the yarn being unwound from a usual bobbin.

Each yarn fed to a textile machine must be monitored for breakage during its unwinding from the corresponding bobbin so that if breakage occurs the machine is halted in order not to produce defective articles. There is also the problem of compensating any excess tension arising in the yarn during its feed to the textile machine, in order to avoid such breakage.

Various anti-pull devices are known, such as those described in U.S. Pat. Nos. 3,789,631 and 3,863,466. These devices are able to act if the yarn is subjected to pulling or excess tension, in order to release it by dropping or disengaging an arm opposed by a force-adjustable spring, the movement of said arm, on releasing the yarn, causing stoppage of the textile machine to which the device is applied.

Such anti-pull devices hence prevent breakage of the yarn under control, so reducing production defects or damage to the textile machine.

These anti-pull devices are generally located above the textile machine at a height difficult to reach by the operator, and when the yarn falls on its release by the movable arm this arm has to be returned to its working position (i.e. the device has to be reset) and the corresponding yarn has to be returned to it (either while it is being moved or afterwards). This has to be done either manually by the operator or by complicated and costly mechanisms, such as that described in U.S. Pat. No. 3,863,466. In either case the cost of this operation negatively affects the cost of the finished product.

In addition, to prevent an excessive number of stoppages of the textile machine the springs associated with the movable arm (or release arm) of these devices are adjusted such that the arm is able to release the yarn only if very strong pulling or excess tension occurs. In many textile machine operations, such as in stocking production, this can cause small holes or streaking in the knitwork, leading to defective article production.

In addition, these devices cannot compensate excess tension because they react drastically on the textile machine operation in the sense that they merely halt it whether the yarn is subjected to small or large excess tension.

OBJECTS AND SUMMARY OF THE INVENTION

An object of the present invention is to provide a device for controlling the feed of at least one yarn to a textile machine and for compensating any pulling and excess tension exerted on the yarn during said feed.

A further object is to provide a device which is simple to use and does not require special additional accessories such as resetting devices or the like for its use.

A further object is to provide a device of the stated type which is able to compensate any type of excess tension in the textile machine, so maintaining a constant tension and preventing the formation of defects in the product or an excessive number of machine stoppages. A further object is to provide a device of the stated type able to control and compensate excess tension arising in the yarn in such a manner as to halt the textile machine only if such abnormality persists beyond a predetermined time period and/or only if a particular yarn tension is exceeded.

A further object is to provide a device of the stated type which is of simple, economical and universal application.

These and further objects which will be apparent to the expert of the art are attained by a device of the stated type, in accordance with the characterising part of the independent claim.

BRIEF DESCRIPTION OF THE DRAWINGS

The invention will be more apparent from the accompanying drawing, which is provided by way of non-limiting example and in which.

DETAILED DESCRIPTION OF THE INVENTION

Figure 1:
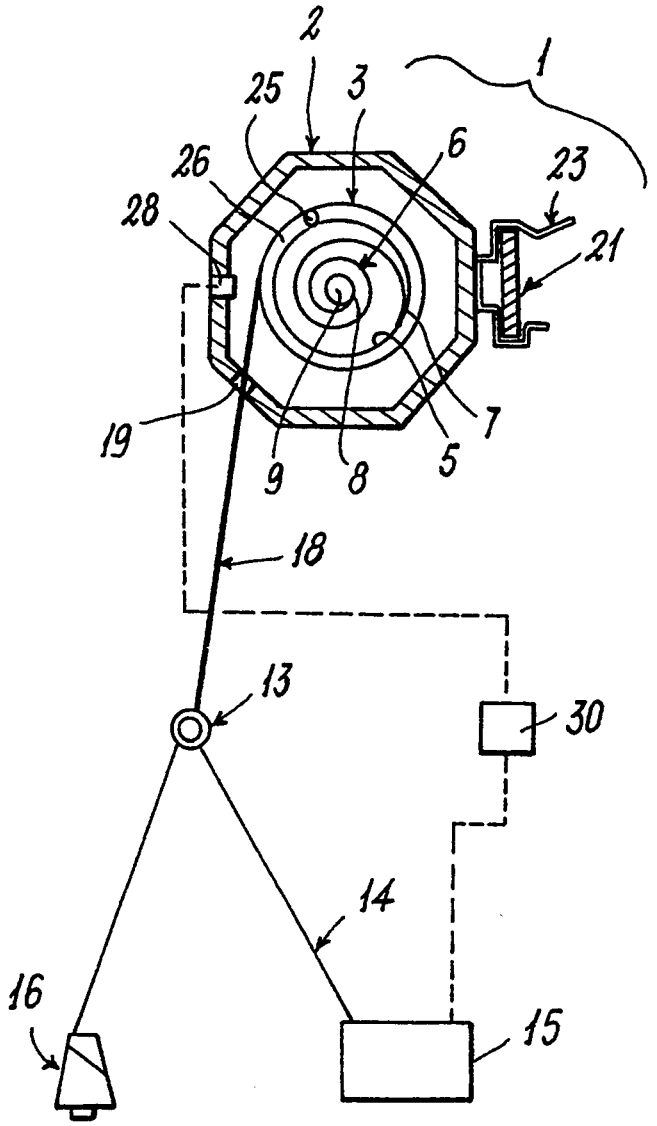
FIG. 1 is a schematic view of the device of the invention, with some parts shown in section for greater clarity.
Figure 2:
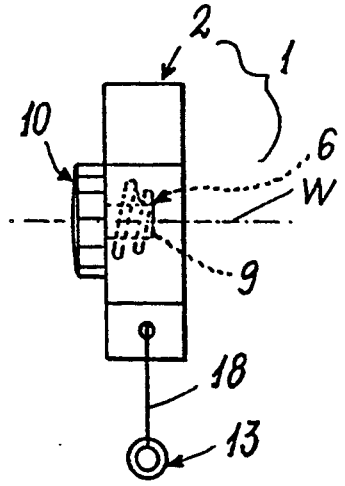
FIG. 2 is a side view of the device of FIG. 1.

With reference to said figures, the device of the invention is indicated overall by 1 and comprises a box casing 2 containing a rotary member 3 rotatable about an axis W. This rotary member is associated, via its inner part 5, with one end 7 of a spring or spiral 6 secured at its other end to a pin 9, the axis of which coincides with said axis W. This pin is fixed to a knob 10 external to the box casing 2, by which the spring 6 can be preloaded or released depending on the use of the device and its requirements. The (adjustment) knob 10 can be set in various angular positions on the box casing 2 via usual toothed means (not shown) associated with said knob and casing.

The spring 6 is preferably and advantageously a spring of known constant force type, i.e. a spring which acts always with the same intensity on the rotary member 3 independently of the angular position assumed by this latter within the box casing 2. In this respect, the member 3 moves within said casing in accordance with the movement of an annular yarn guide element 13 external to the casing 2 and cooperating with a yarn 14 fed to any known textile machine 15, for example a knitting machine for stockings or other knitwork.

Specifically, the element 13 supports the yarn 14 (which slides within the element 13) during its feed to the textile machine and its corresponding unwinding from a known bobbin 16. The element 13 is associated with a usual cable 18, for example of plastics, which is wound about the rotary member 3 and secured thereto at its free end (not shown). The cable 18 leaves the casing 2 through an aperture 19 provided therein.

The device 1, the casing 2 of which is associated with a support element 21 (positioned preferably above the textile machine 15) via a usual elastically deformable member or clip 23, comprises means for sensing the movement of the support element 13 relative to said casing. Specifically, with the rotary member 3 there is associated (in one embodiment of the invention) a metal element, preferably magnetic such as a permanent magnet 25, positioned at its end edge 26. The element or magnet 25 is arranged to cooperate with a presence sensor element 28 associated directly with the casing 2, said sensor element 28 being connected to a control unit 30 of the machine 15, for example an electrical and/or electronic circuit or microprocessor circuit of any known type. By way of example the sensor element can be a known magnetic switch in a glass bulb (reed switch 28*b*) or, a magnetic field sensor of hall effect type 28*a*, or a usual proximity sensor. Alternatively, the element 25 can be a simple pin 25*l* projecting from the rotary member 3, and the element 28 can be a microswitch 28*c* of any known type.

It will be assumed that the yarn 14 is fed to the textile machine 15 and that the adjustment knob 10 has been set to an angular position (on the casing 2) such as to preload the spring 6 with a constant force of 3 grams. With this setting, the spring maintains the cable 18 completely wound about the member 3 within the casing 2 by virtue of its direct action on said member 3.

This enables the textile machine 15 to operate freely on the yarn 14.

It will now be assumed that because of a superimposing error in the winding of the turns of yarn 14 on the bobbin 16, the yarn suddenly becomes blocked in its travel towards the textile machine 15. However, the machine continues to draw the yarn 14 required for its operation, with the result that tension arises in said yarn and hence in the supporting yarn guide element 13. As this latter is associated with the cable 1,, it acts directly on the rotary member 3 associated with the spring 6. This latter, which is preloaded with a force of 3 grams, is pulled (via the aforesaid members) by the yarn 14 which, when its tension (generated by the machine 15) exceeds 3 grams, begins to unwind the cable 18 from the member 3. This compensates the yarn requirement of the textile machine 15, the bobbin 16 being blocked.

If the force of 3 grams applied to the turns wrongly superimposed on the bobbin 16 is able to release the yarn (and hence enable the bobbin to rotate in known manner about its axis), the member 3 rotates about its axis W under the action of the spring, to again wind the cable 18 about it. This prevents yarn breakage by high excess tension exceeding the predetermined 3 grams, which could have produced a defect in the article under production.

In addition, as the release of the bobbin and the resumption of yarn travel occur before the magnet 25 reaches the element 28, there is no stoppage of the machine 15, which would have penalized the machine production process.

It will now be assumed that in contrast to the aforegoing, the turns wrongly superimposed on the bobbin 16 remain blocked. In this case the continuous pulling of the yarn 14 by the textile machine 15 (in known manner) results in continuous prolonged unwinding of the cable 18 by the pulley B (which hence exceeds an elongation limit set by the operator).

Consequently the magnet 25 reaches a position corresponding with the element 28, which senses its presence and generates in any known manner a signal which is fed to the unit 30. On receiving this signal, this unit operates the (known) actuator governing the operation of the textile machine, to halt it. Consequently the machine stops and the (excessive) tension generated in the yarn 14 ceases. This prevents yarn breakage.

At this point to return the textile machine 15 to operation it is sufficient to remove the cause which maintained the turns of yarn 14 wrongly superimposed on the bobbin 16. After this the cable 18 again winds about the member 3, which is rotated about the axis W by the spring 6 to immediately reset the device without requiring the use of special tools or loading rods, with consequent time saving. This allows immediate restart of the textile machine 15, which can be done automatically by the unit 30. In this respect this latter senses the return of the element or magnet 25 in front of the sensor element 28, and on the basis of this and of a known comparison algorithm acts on the actuator governing the operation of the textile machine, to start it.

It should also be noted that the diameter of the annular element 13 can be chosen at will, depending on which defects (knots or enlargements) in the yarn 14 are considered acceptable for the current production of the machine 15. In this respect, if for example the diameter of this element is decreased, those defects, such as knots, of size greater than this diameter (and hence undesirable) halt the travel of the yarn 14 through the element 13 and hence the movement of this latter (as already described) relative to the casing 2. This consequently causes the machine 15 to stop for the aforestated reasons, so preventing defects forming in the article produced by the machine. The operator can act to eliminate the knot and hence restore optimum conditions for the use of the yarn 14.

The element 13 can therefore also be used as a sensor for detecting defects in the yarn 14, and generally the device 1 can be used to verify that the yarn is in the best condition for obtaining a product without defects.

Figures 3, 3A:
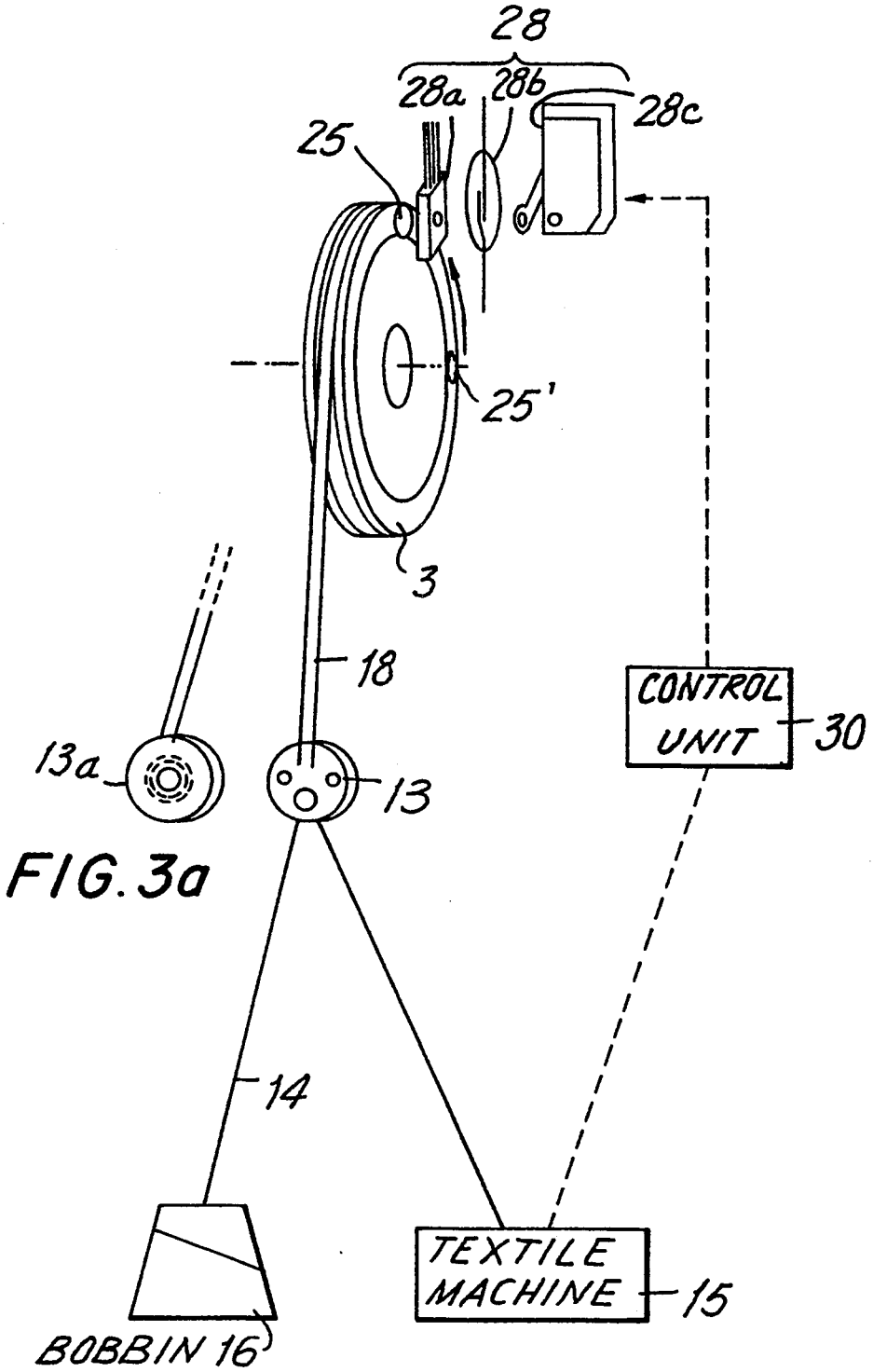

Advantageously the element 13 comprises a plurality of holes of different diameter or a hole of variable diameter 13' as shown in FIG. 3*a* (such as a shutter) so that the operator can choose the preferred hole diameter on the basis of the yarn defects or knots to be detected.

A particular embodiment of the device has been described. However other embodiments are possible, such as one in which the element 28 can be connected to an electronic circuit able to count the number of revolutions of the member 3 about the axis W and allow stoppage of the textile machine 15 only on attaining an unwinding limit set at will by the textile machine operator.

In an alternative embodiment, the unit 30 acts on the machine 15 to halt it if, during a time period or operating period which can be set at will, a plurality of successive elongations occur which do not however reach the set acceptable maximum elongation limit. In this case the unit 30 detects this plurality of elongations via the elements 25 and 28 (for example as consecutive rotations of the member 3 in opposing directions about the axis W) and acts on the machine 15 to halt it because in such a case the yarn has undergone continuous pulling, and the product obtained from it could comprise defects (such as streaking).

Such embodiments are to be considered as falling within the scope of the present document.

I claim:

1. A device for controlling the feed of at least one yarn from a bobbin to a textile machine and compensating for pulling and excess tension exerted on the yarn, comprising support means for supporting the yarn as the yarn is fed to the textile machine, a rotary member coupled to said support means for rotation upon movement of said support means, compensation means coupled to said rotary member for compensating for movement of said support means and consequently rotation of said rotary member, sensor means coupled to said rotary member for sensing the rotation of said rotary member and thus the movement of said support means, and control means connected to said sensor means and controlling the textile machine to halt the textile machine when a predetermined movement limit for said support means is reached.

2. The device of claim 1, wherein said support means comprise an annular element, the device further comprising a cable for connecting said annular element to said rotary member.

3. The device of claim 2, further comprising a casing in which said rotary member is arranged, and a support member for fixedly supporting said casing on the textile machine, said cable being arranged to wind and unwind about said rotary member.

4. The device of claim 3, further comprising an elastically deformable member for coupling said casing to the textile machine, said casing being box-like and comprising an aperture through which said cable is passed.

5. The device of claim 1, wherein said compensation means comprise a spiral spring arranged in an interior of said rotary member.

6. The device of claim 5, wherein said spring provides a substantially constant elastic force.

7. The device of claim 5, further comprising a preloading member for varying the elasticity of said spring.

8. The device of claim 3, wherein said compensation means comprise a spiral spring and a preloading member for varying the elasticity of said spring, said preloading member comprising a knob arranged external to said casing and a pin arranged in an interior of said knob, said knob having discrete angular positions relative to said casing, a first end of said spring being connected to said pin.

9. The device of claim 8, wherein a second end of said spring opposite to said first end is connected to said rotary member.

10. The device of claim 3, wherein said sensor means comprise a first element fixed on an outer edge said rotary member, and a second element fixed to said casing.

11. The device of claim 10, wherein said first element is a permanent magnet.

12. The device of claim 10, wherein said first element is a pin projecting from said rotary member and said second element is a microswitch arranged to cooperate with said pin.

13. The device of claim 10, wherein said second element is a magnetic field sensor of a hall effect type.

14. The device of claim 10, wherein said second element is a magnetic switch arranged within a glass bulb or a reed switch.

15. The device of claim 10, wherein said second element is coupled to said control means.

16. The device of claim 1, wherein said control means comprise a control unit selected from the group consisting of an electrical circuit, an electronic circuit, a microprocessor circuit and combinations thereof, said control unit being connected to an actuator for operating the textile machine.

17. The device of claim 1, wherein said control means detect a limit of the movement of said support means by sensing the rotation of said rotary member about its axis.

18. The device of claim 1, wherein said control means halts operation of the textile machine if said rotary member undergoes a plurality of consecutive rotations in opposite directions about its axis during a predetermined time period or operating period.

19. The device of claim 2, wherein said annular element has a diameter corresponding to an acceptable range of defects contained in the yarn fed to the textile machine.

20. The device of claim 2, wherein said annular element has a variable diameter hole.

21. The device of claim 1, wherein said support means comprise an annular element having plurality of holes having different diameters.

* * * * *

UNITED STATES PATENT AND TRADEMARK OFFICE

CERTIFICATE OF CORRECTION

PATENT NO. 5,353,610

DATED October 11, 1994

INVENTOR(S) : Tiziano BAREA

It is certified that error appears in the above—identified patent and that said Letters Patent is hereby corrected as shown below:

Column 2, line 24, insert--Figs. 3 and 3a are perspective views of the device shown in Fig. 1--

Column 3, line 9, change "251" to --25'--.

Signed and Sealed this

Twenty-fourth Day of January, 1995

*Attest:*

Bruce Lehman

BRUCE LEHMAN

*Attesting Officer*

*Commissioner of Patents and Trademarks*